US010959527B2

(12) United States Patent
Orde

(10) Patent No.: US 10,959,527 B2
(45) Date of Patent: Mar. 30, 2021

(54) FOLDABLE CHAIR ASSEMBLY WITH INDEPENDENTLY ADJUSTABLE LEGS

(71) Applicant: Chad Bruce Orde, Pentwater, MI (US)

(72) Inventor: Chad Bruce Orde, Pentwater, MI (US)

( * ) Notice: Subject to any disclaimer, the term of this patent is extended or adjusted under 35 U.S.C. 154(b) by 0 days.

(21) Appl. No.: 16/424,680

(22) Filed: May 29, 2019

(65) Prior Publication Data

US 2020/0375364 A1 Dec. 3, 2020

(51) Int. Cl.

| | |
|---|---|
| ***A47C 3/36*** | (2006.01) |
| ***A47C 4/00*** | (2006.01) |
| ***A47C 4/10*** | (2006.01) |
| ***A47C 4/20*** | (2006.01) |
| ***A47C 4/46*** | (2006.01) |
| ***A47C 7/00*** | (2006.01) |
| ***A47C 3/18*** | (2006.01) |
| ***A47C 1/14*** | (2006.01) |

(52) U.S. Cl.

CPC ..... *A47C 4/46* (2013.01); *A47C 1/14* (2013.01); *A47C 3/18* (2013.01); *A47C 3/36* (2013.01); *A47C 7/008* (2013.01)

(58) Field of Classification Search

CPC .... A47C 1/14; A47C 3/18; A47C 4/46; A47C 7/008; A47C 3/36

USPC ..... 297/51, 53, 54, 344.12

See application file for complete search history.

(56) References Cited

U.S. PATENT DOCUMENTS

| | | | | | |
|---|---|---|---|---|---|
| 430,703 | A * | 6/1890 | Spahn et al. | A47C 4/10 | 297/54 |
| 1,302,828 | A * | 5/1919 | Miller | A47C 4/10 | 297/54 |
| 1,944,335 | A * | 1/1934 | Wyck | A47C 4/10 | 248/439 |
| 2,350,013 | A * | 5/1944 | Burlin | A47C 4/10 | 297/54 |
| 2,514,309 | A * | 7/1950 | Burlin | A47C 4/10 | 297/54 |
| 2,615,499 | A * | 10/1952 | Wallace | A47C 3/36 | 297/325 |
| 2,876,825 | A * | 3/1959 | Boortz | A47C 4/20 | 297/54 X |
| 4,597,119 | A * | 7/1986 | Padgett | A47C 1/14 | 5/656 |
| 4,889,383 | A * | 12/1989 | Jones | A47C 4/02 | 297/54 X |
| 4,894,877 | A * | 1/1990 | Marsh | A47C 1/143 | 297/53 X |

(Continued)

FOREIGN PATENT DOCUMENTS

| | | | | |
|---|---|---|---|---|
| CH | 282034 A * | 4/1952 | ..... | A47C 4/46 |
| CH | 295949 A * | 1/1954 | ..... | A47C 4/44 |

(Continued)

*Primary Examiner* — Rodney B White

(74) *Attorney, Agent, or Firm* — James E. Shultz, Jr.

(57) ABSTRACT

Foldable chair assemblies are provided. More particularly, foldable chair assemblies are provided with independently adjustable legs. The foldable chair assemblies with independently adjustable legs may be stably placed on uneven surfaces (e.g., sloped ground, uneven ground, hill sides, sloped floors, etc.). The foldable chair assemblies may include a chair that is swivelable and/or pivotable with respect to a base. The chairs may include a chair back that is pivotable with respect to a chair seat.

17 Claims, 5 Drawing Sheets

(56) References Cited

U.S. PATENT DOCUMENTS 5,211,172 A * 5/1993 McGuane ..... A47C 1/14 297/217.3
5,246,265 A * 12/1993 Nagan et al. ..... A47C 3/38 297/54
5,494,333 A * 2/1996 Wilson ..... A47C 7/008 297/344.18
5,567,014 A * 10/1996 Fitch ..... A47C 3/18 297/54 X
5,845,962 A * 12/1998 Lin ..... A47C 4/02 297/54
6,012,769 A * 1/2000 Hsueh ..... A47C 3/16 297/19
6,663,176 B1 * 12/2003 Tull ..... A47C 1/06 297/53 X
6,698,828 B1 * 3/2004 Chan ..... A47C 4/06 297/54
6,890,033 B1 * 5/2005 Casella ..... A47C 1/14 297/344.21
6,905,172 B1 * 6/2005 Barnett ..... A47C 7/008 297/344.12
7,328,953 B2 * 2/2008 Werschmidt ..... A47K 3/125 297/34
7,740,309 B2 * 6/2010 Mayercheck ..... A47C 4/14 297/51
8,182,031 B1 * 5/2012 MacKenzie ..... A47B 3/08 297/51
8,332,971 B2 * 12/2012 Bennett et al. ..... A47K 3/122 4/560.1
8,474,916 B2 * 7/2013 Smith ..... A47C 3/18 297/440.1
8,567,860 B2 * 10/2013 Jue ..... A47C 4/44 297/53 X
9,415,702 B2 * 8/2016 Auger ..... B60N 2/062
9,675,177 B1 * 6/2017 Letourneau et al. .. A47C 7/008
9,839,292 B2 * 12/2017 Miller ..... A47C 1/03255
2008/0203802 A1 * 8/2008 LaFreniere ..... A47C 4/46 297/411.35
2009/0243346 A1 * 10/2009 Chen ..... B63H 21/213 297/51

FOREIGN PATENT DOCUMENTS

FR 959057 A * 3/1950 ..... A47C 4/46
GB 2219934 A * 12/1989 ..... A47C 4/30

* cited by examiner

FOLDABLE CHAIR ASSEMBLY WITH INDEPENDENTLY ADJUSTABLE LEGS

TECHNICAL FIELD

The present disclosure generally relates to foldable chair assemblies. More particularly, the present disclosure relates to foldable chair assemblies with independently adjustable legs.

BACKGROUND

Foldable chairs are often used in circumstances such as setting outside in a lawn, setting inside, carrying to outdoor events, etc. Known foldable chairs are expensive and flimsy. Typically, folding chairs are unstable when place on uneven surfaces.

Improved foldable chair assemblies are needed. Foldable chair assemblies are needed with independently adjustable legs. Foldable chair assemblies are needed that may be stably placed on uneven surfaces (e.g., sloped ground, uneven ground, hill sides, sloped floors, etc.). Foldable chair assemblies are needed with a chair that is swivelable and/or pivotable with respect to a base. Chairs are needed with a chair back that is pivotable with respect to a chair seat. Foldable chairs are needed that are transportable and/or storable.

SUMMARY

A foldable chair assembly may include a chair and a base having four legs. Each leg may be independently adjustable with respect to any other leg. The chair may be swivebly supported on the base.

In another embodiment, a foldable chair may include a chair and a base having four legs. Each leg may be swivably adjustable with respect to the base.

In a further embodiment, a foldable chair assembly may include a base having at least two legs. A first leg of the at least two legs may be pivotably adjustable with respect to the base. A second leg of the at least two legs may be pivotably adjustable with respect to the base. The first leg of the at least two legs may be independently pivotably adjustable with respect to the second leg of the at least two legs.

DETAIL DESCRIPTION

Foldable chair assemblies are provided. The foldable chair assemblies may include independently adjustable legs. The foldable chair assemblies may be stably placed on uneven surfaces (e.g., sloped ground, uneven ground, hill sides, sloped floors, etc.). The foldable chair assemblies may include a chair that is swivelable and/or pivotable with respect to a base. The chairs may include a chair back that is pivotable with respect to a chair seat.

Figure 1:
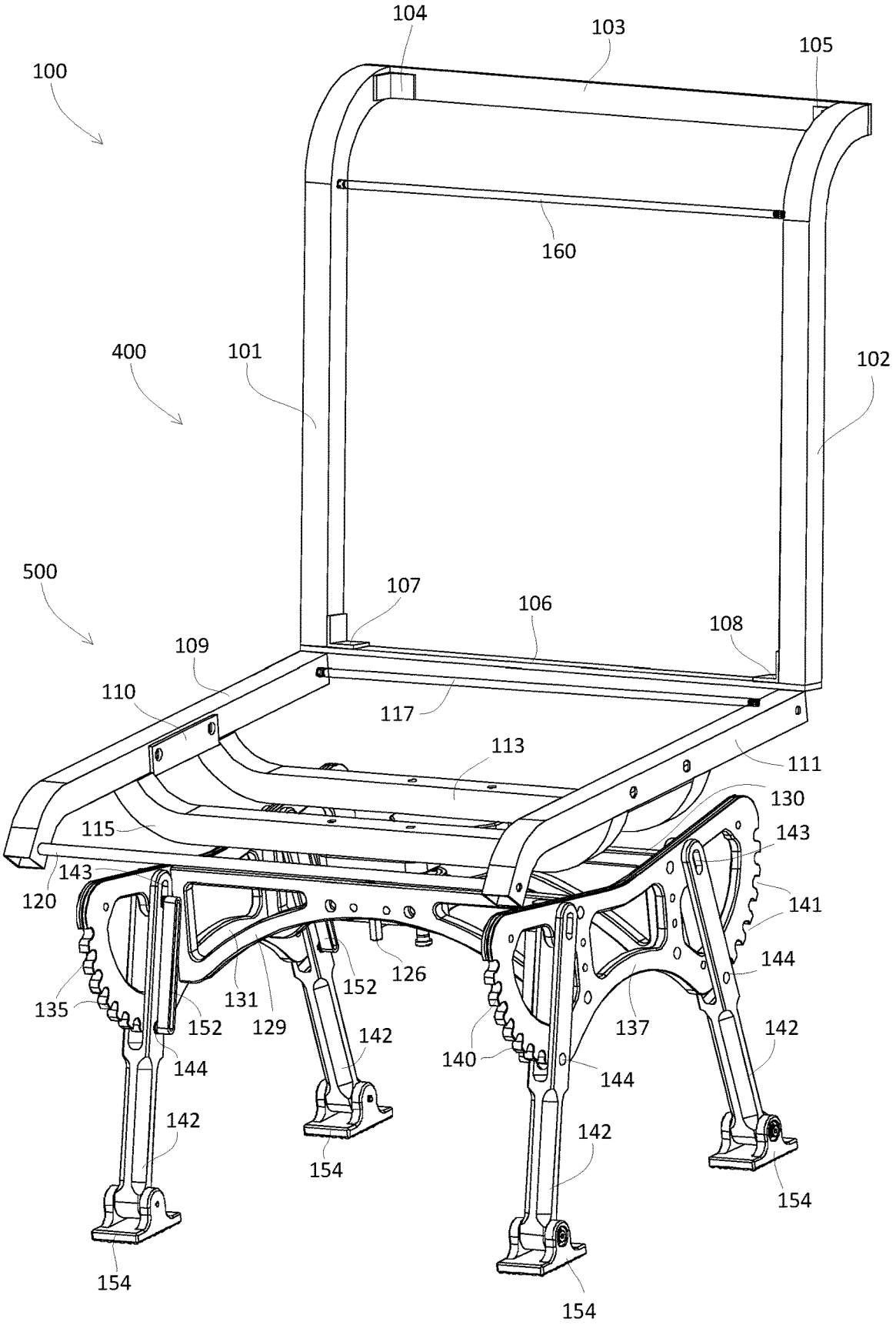
FIG. 1 depicts a top front perspective view of an example foldable chair assembly.

Turning to FIG. 1, a foldable chair assembly 100 may include a chair 400 and a base 500. As described in more detail elsewhere herein, the chair 400 may swivel with respect to the base 500. As further described elsewhere herein, the chair 400 may pivot (e.g., front to back) with respect to the base 500. The chair assembly 100 may include a chair swivel/pivot lock mechanism 126 that may, for example, allow a chair occupant to swivel and/or pivot the chair 400 relative to the base 500 to a desired orientation, and lock the chair 400 relative the base 500.

The chair 400 may include a first chair back side rail 101, a second chair back side rail 102, a top chair back cross member 103, a bottom chair back cross member 106, and an intermediate chair back cross member 160. The top chair back cross member 103 may be fixed to the first chair back side rail 101 via, for example, a first chair back bracket 104 (e.g., via welding, screws, bolts, etc.). Alternative, or additionally, the top chair back cross member 103 may be directly fixed to the first chair back side rail 101 (e.g., via welding, screws, bolts, etc.). The top chair back cross member 103 may be fixed to the second chair back side rail 102 via, for example, a second chair back bracket 105 (e.g., via welding, screws, bolts, etc.). Alternative, or additionally, the top chair back cross member 103 may be directly fixed to the second chair back side rail 102 (e.g., via welding, screws, bolts, etc.). The bottom chair back cross member 106 may be fixed to the first chair back side rail 101 via, for example, a third chair back bracket 107 (e.g., via welding, screws, bolts, etc.). Alternative, or additionally, the bottom chair back cross member 106 may be directly fixed to the first chair back side rail 101 (e.g., via welding, screws, bolts, etc.). The bottom chair back cross member 106 may be fixed to the second chair back side rail 102 via, for example, a fourth chair back bracket 108 (e.g., via welding, screws, bolts, etc.). Alternative, or additionally, the bottom chair back cross member 106 may be directly fixed to the second chair back side rail 102 (e.g., via welding, screws, bolts, etc.). The intermediate chair back cross member 160 may be fixed to the first chair back side rail 101 and the second chair back side rail 102 via, for example, welding, screws, bolts, etc.

The chair 400 may include a first chair seat side rail 109, a second chair seat side rail 111, a rear chair seat cross member 117, a front chair seat cross member 120, a first intermediate chair seat cross member 113, and a second intermediate chair seat cross member 115. The rear chair seat cross member 117 may be fixed to the first chair seat side rail 109 and the second chair seat side rail 111 via, for example, welding, screws, bolts, etc. The first intermediate chair seat cross member 113 may be fixed to the first chair seat side rail 109 via, for example, a first chair seat bracket 110 (e.g., via welding, screws, bolts, etc.). Alternative, or additionally, the first intermediate chair seat cross member 113 may be directly fixed to the first chair seat side rail 109 (e.g., via welding, screws, bolts, etc.). The first intermediate chair seat cross member 113 may be fixed to the second chair seat side rail 111 via, for example, a second chair seat bracket (not shown in FIG. 1) (e.g., via welding, screws, bolts, etc.). Alternative, or additionally, the first intermediate chair seat cross member 113 may be directly fixed to the second chair seat side rail 111 (e.g., via welding, screws, bolts, etc.). The second intermediate chair seat cross member 115 may be fixed to the first chair seat side rail 109 via, for example, the first chair seat bracket 110 (e.g., via welding, screws, bolts, etc.). Alternative, or additionally, the second intermediate chair seat cross member 115 may be directly fixed to the first chair seat side rail 109 (e.g., via welding, screws, bolts, etc.). The second intermediate chair seat cross member 115 may be fixed to the second chair seat side rail 111 via, for example, the second chair seat bracket (not shown in FIG. 1) (e.g., via welding, screws, bolts, etc.). Alternative, or additionally, the second intermediate chair seat cross member 115 may be directly fixed to the second chair seat side rail 111 (e.g., via welding, screws, bolts, etc.). The front chair seat cross member 120 may be fixed to the first chair seat side rail 109 and the second chair seat side rail 111 via, for example, welding, screws, bolts, etc.

The chair back may pivot with respect to the chair seat. For example, the bottom of the chair back may be hingedly attached to the rear of the chair seat such that the chair back will fold flat against the chair seat. Thereby, a height of the foldable chair assembly 100 may be reduced for transporting and/or storing the flodable chair assembly 100. Similarly, the bottom of the chair back may be hingedly attached to the rear of the chair seat such that the chair back may recline relative to the chair seat. In any event, the bottom of the chair back may be hingedly attached to the rear of the chair seat via a mechanism that allows a user to reorient the chair back with respect to the chair seat in any number of orientations between an orientation where the chair back is folded against the chair seat and where the chair back is fully reclined, for example, parallel to the chair seat (e.g., the chair back and the chair seat may define a cot).

While not shown in FIG. 1, the foldable chair assembly 100 may include a "sling-type" occupant support extending, for example, between the first chair seat side rail 109 and the second chair seat side rail 111, and between the first chair back side rail 101 and the second chair back side rail 102. Additionally, or alternatively, the foldable chair assembly 100 may include a "sling-type" occupant support extending, for example, from the top chair back cross member 103 and the bottom chair back cross member 106, and from the rear chair seat cross member 117 to the front chair seat cross member 120. The sling-type occupant support may include, for example, a polyvinyl chloride (PVC) mesh fabric, a vinyl-coated polyester material, an acrylic yarn, an olefin material, etc. The sling-type occupant support may include a composition of materials that is durable, easy-to-clean, colorfast, strong outdoor fabric, etc. The sling-type occupant support may include a composition of materials that inhibits mildew growth. Additionally, or alternatively, the chair back and/or the chair seat may include a rigid occupant support (e.g., wooden slats, plastic slats, aluminum slats, etc.). While not shown in FIG. 1, the chair 400 may include a fixed or removable cushion.

The base 500 may include a first side structure 131 fixed to a second side structure 137 via, for example, a front base cross member 129 and a back base cross member 130. The base 500 may include, for example, four pivotable legs 142. Each pivotable leg 142 may include, for example, a slotted pivot point 143, a leg pivot locating pin 144, a leg biasing member 152 (e.g., an elastic band, a rubber band, a spring, etc.), and a pivotable foot 154. The first side structure 131 may include a series of front leg pivot slots 135 and a series of rear leg pivot slots (not shown in FIG. 1). Similarly, the second side structure 137 may include a series of front leg pivot slots 140 and a series of rear leg pivot slots 141. As described in detail elsewhere herein, a chair user may pivot a respective leg 142 by first linearly pulling the leg 142 toward a respective foot 154 such that the leg pivot locating pin 144 disengages a respective leg pivot slot 135, 140, 141 and the slotted pivot point 143 slides on a respective pin (not shown in FIG. 1), thereby, stretching the respective leg biasing member 152. Once the leg pivot locating pin 144 disengages the respective leg pivot slot 135, 140, 141, the user may pivot the leg 142 frontward or rearward as desired. Once the leg 142 is pivoted as desired, the user may release the leg 142 and the leg biasing member 152 may linearly retract the leg 142 toward the base 500 such that the leg pivot locating pin 144 engages the respective leg pivot slot 135, 140, 141.

Figure 2:
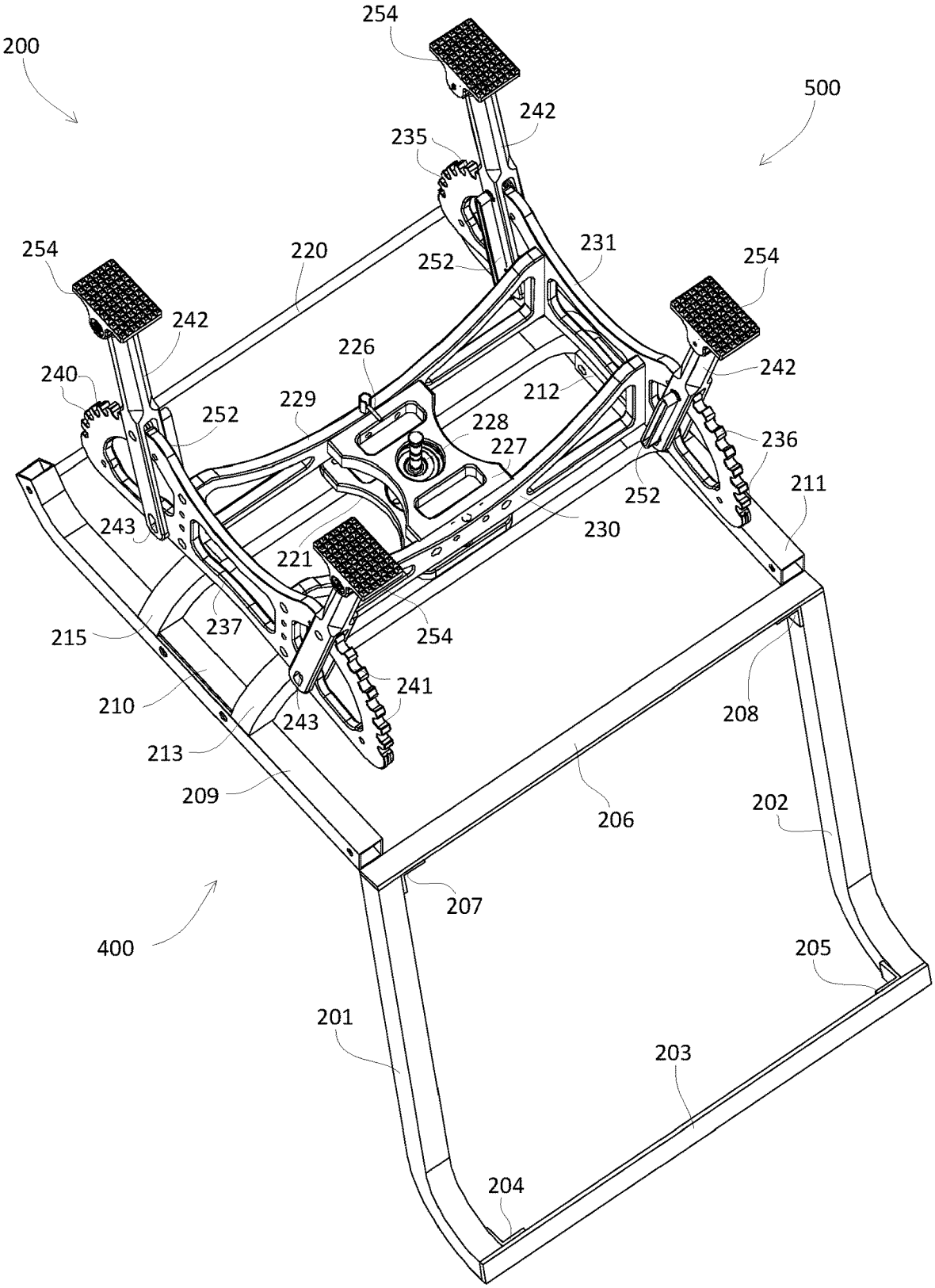
FIG. 2 depicts a bottom rear perspective view of the example foldable chair assembly of FIG. 1.

With reference to FIG. 2, a foldable chair assembly 200 may include a chair 400 and a base 500. The foldable chair assembly 200 may be similar to, for example, the foldable chair assembly 100 of FIG. 1. The chair 400 may swivel about, for example, a swivel pin 228 with respect to the base 500. As further described elsewhere herein, the chair 400 may pivot (e.g., front to back) with respect to the base 500. The foldable chair assembly 200 may include a chair swivel/pivot lock mechanism 226 that may, for example, allow a chair occupant to swivel and/or pivot the chair 400 relative to the base 500 to a desired orientation, and lock the chair 400 relative the base 500.

The chair 400 may include a first chair back side rail 201, a second chair back side rail 202, a top chair back cross member 203, and a bottom chair back cross member 206. The top chair back cross member 203 may be fixed to the first chair back side rail 201 via, for example, a first chair back bracket 204 (e.g., via welding, screws, bolts, etc.). Alternative, or additionally, the top chair back cross member 203 may be directly fixed to the first chair back side rail 201 (e.g., via welding, screws, bolts, etc.). The top chair back cross member 203 may be fixed to the second chair back side rail 202 via, for example, a second chair back bracket 205 (e.g., via welding, screws, bolts, etc.). Alternative, or additionally, the top chair back cross member 203 may be directly fixed to the second chair back side rail 202 (e.g., via welding, screws, bolts, etc.). The bottom chair back cross member 206 may be fixed to the first chair back side rail 201 via, for example, a third chair back bracket 207 (e.g., via welding, screws, bolts, etc.). Alternative, or additionally, the bottom chair back cross member 206 may be directly fixed to the first chair back side rail 201 (e.g., via welding, screws, bolts, etc.). The bottom chair back cross member 206 may be fixed to the second chair back side rail 202 via, for example, a fourth chair back bracket 208 (e.g., via welding, screws, bolts, etc.). Alternative, or additionally, the bottom chair back cross member 206 may be directly fixed to the second chair back side rail 202 (e.g., via welding, screws, bolts, etc.).

The chair 400 may include a first chair seat side rail 209, a second chair seat side rail 211, a front chair seat cross member 220, a first intermediate chair seat cross member 213, and a second intermediate chair seat cross member 215. The first intermediate chair seat cross member 213 may be fixed to the first chair seat side rail 209 via, for example, a first chair seat bracket 210 (e.g., via welding, screws, bolts, etc.). Alternative, or additionally, the first intermediate chair seat cross member 213 may be directly fixed to the first chair seat side rail 209 (e.g., via welding, screws, bolts, etc.). The first intermediate chair seat cross member 213 may be fixed to the second chair seat side rail 211 via, for example, a second chair seat bracket 212 (e.g., via welding, screws, bolts, etc.). Alternative, or additionally, the first intermediate chair seat cross member 213 may be directly fixed to the second chair seat side rail 211 (e.g., via welding, screws, bolts, etc.). The second intermediate chair seat cross member

215 may be fixed to the first chair seat side rail 209 via, for example, the first chair seat bracket 210 (e.g., via welding, screws, bolts, etc.). Alternative, or additionally, the second intermediate chair seat cross member 215 may be directly fixed to the first chair seat side rail 209 (e.g., via welding, screws, bolts, etc.). The second intermediate chair seat cross member 215 may be fixed to the second chair seat side rail 211 via, for example, the second chair seat bracket 212 (e.g., via welding, screws, bolts, etc.). Alternative, or additionally, the second intermediate chair seat cross member 215 may be directly fixed to the second chair seat side rail 211 (e.g., via welding, screws, bolts, etc.). The front chair seat cross member 220 may be fixed to the first chair seat side rail 209 and the second chair seat side rail 211 via, for example, welding, screws, bolts, etc. The chair 400 may include a chair pivot bracket 221 extending between the first intermediate chair seat cross member 213 and the second intermediate chair seat cross member 215.

The chair back may pivot with respect to the chair seat. For example, the bottom of the chair back may be hingedly attached to the rear of the chair seat such that the chair back will fold flat against the chair seat. Thereby, a height of the foldable chair assembly 200 may be reduced for transporting and/or storing the foldable chair assembly 200. Similarly, the bottom of the chair back may be hingedly attached to the rear of the chair seat such that the chair back may recline relative to the chair seat. In any event, the bottom of the chair back may be hingedly attached to the rear of the chair seat via a mechanism that allows a user to reorient the chair back with respect to the chair seat in any number of orientations between an orientation where the chair back is folded against the chair seat and where the chair back is fully reclined, for example, parallel to the chair seat (e.g., the chair back and the chair seat may define a cot).

While not shown in FIG. 2, the foldable chair assembly 200 may include a "sling-type" occupant support extending, for example, between the first chair seat side rail 209 and the second chair seat side rail 211, and between the first chair back side rail 201 and the second chair back side rail 202. Additionally, or alternatively, the foldable chair assembly 200 may include a "sling-type" occupant support extending, for example, from the top chair back cross member 203 to the bottom chair back cross member 206 and on to the front chair seat cross member 220. The sling-type occupant support may include, for example, a polyvinyl chloride (PVC) mesh fabric, a vinyl-coated polyester material, an acrylic yarn, an olefin material, etc. The sling-type occupant support may include a composition of materials that is durable, easy-to-clean, colorfast, strong outdoor fabric, etc. The sling-type occupant support may include a composition of materials that inhibits mildew growth. Additionally, or alternatively, the chair back and/or the chair seat may include a rigid occupant support (e.g., wooden slats, plastic slats, aluminum slats, etc.). While not shown in FIG. 2, the chair 400 may include a fixed or removable cushion.

The base 500 may include a first side structure 231 fixed to a second side structure 237 via, for example, a front base cross member 229 and a back base cross member 230. The base 500 may include a base pivot bracket 227 extending between the front base cross member 229 and the back base cross member 230. The base 500 may include, for example, four pivotable legs 242. Each pivotable leg 242 may include, for example, a slotted pivot point 243, a leg pivot locating pin 244, a leg biasing member 252 (e.g., an elastic band, a rubber band, a spring, etc.), and a pivotable foot 254. The first side structure 231 may include a series of front leg pivot slots 235 and a series of rear leg pivot slots 236. Similarly, the second side structure 237 may include a series of front leg pivot slots 240 and a series of rear leg pivot slots 241. As described in detail elsewhere herein, a chair user may pivot a respective leg 242 by first linearly pulling the leg 242 toward a respective foot 254 such that the leg pivot locating pin 244 disengages a respective leg pivot slot 235, 236, 240, 241 and the slotted pivot point 243 slides on a respective pin (not shown in FIG. 2), thereby, stretching the respective leg biasing member 252. Once the leg pivot locating pin 244 disengages the respective leg pivot slot 235, 236, 240, 241, the user may pivot the leg 242 frontward or rearward as desired. Once the leg 242 is pivoted as desired, the user may release the leg 242 and the leg biasing member 252 may linearly retract the leg 242 toward the base 500 such that the leg pivot locating pin 244 engages the respective leg pivot slot 235, 236, 240, 241.

Figure 3:
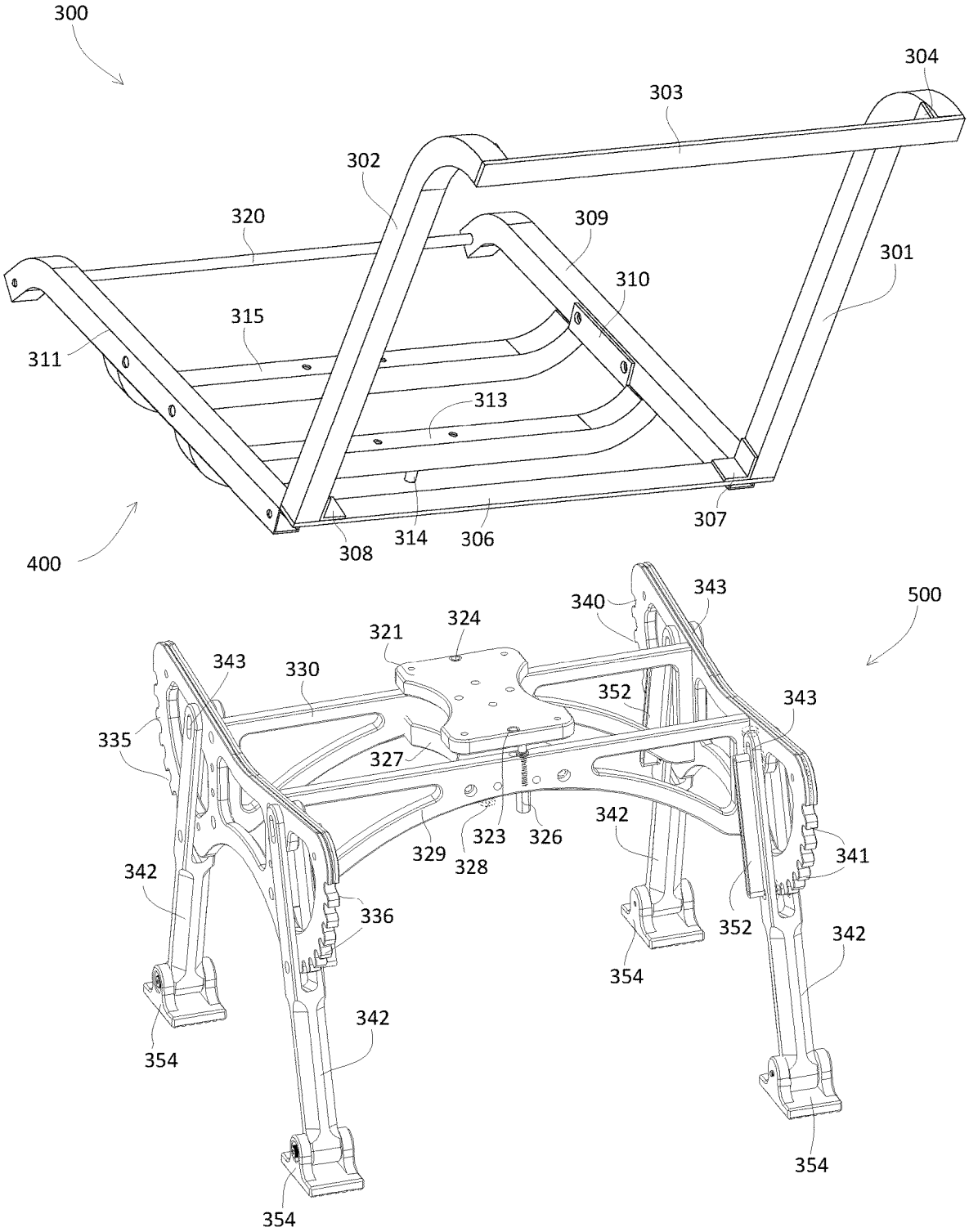
FIG. 3 depicts a top rear perspective view of the example foldable chair assembly of FIG. 1 with a chair separated from a base.

Turning to FIG. 3, a foldable chair assembly 300 may include a chair 400 and a base 500. The foldable chair assembly 300 may be similar to, for example, either the foldable chair assembly 100 of FIG. 1 or the foldable chair assembly 200 of FIG. 2. The chair 400 may swivel about, for example, a swivel pin 328 with respect to the base 500. As further described elsewhere herein, the chair 400 may pivot (e.g., front to back) with respect to the base 500. The foldable chair assembly 300 may include a chair swivel/pivot lock mechanism 326 that may, for example, allow a chair occupant to swivel and/or pivot the chair 400 relative to the base 500 to a desired orientation, and lock the chair 400 relative the base 500.

The chair 400 may include a first chair back side rail 301, a second chair back side rail 302, a top chair back cross member 303, and a bottom chair back cross member 306. The top chair back cross member 303 may be fixed to the first chair back side rail 301 via, for example, a first chair back bracket 304 (e.g., via welding, screws, bolts, etc.). Alternative, or additionally, the top chair back cross member 303 may be directly fixed to the first chair back side rail 301 (e.g., via welding, screws, bolts, etc.). The top chair back cross member 303 may be fixed to the second chair back side rail 302 via, for example, a second chair back bracket 305 (e.g., via welding, screws, bolts, etc.). Alternative, or additionally, the top chair back cross member 303 may be directly fixed to the second chair back side rail 302 (e.g., via welding, screws, bolts, etc.). The bottom chair back cross member 306 may be fixed to the first chair back side rail 301 via, for example, a third chair back bracket 307 (e.g., via welding, screws, bolts, etc.). Alternative, or additionally, the bottom chair back cross member 306 may be directly fixed to the first chair back side rail 301 (e.g., via welding, screws, bolts, etc.). The bottom chair back cross member 306 may be fixed to the second chair back side rail 302 via, for example, a fourth chair back bracket 308 (e.g., via welding, screws, bolts, etc.). Alternative, or additionally, the bottom chair back cross member 306 may be directly fixed to the second chair back side rail 302 (e.g., via welding, screws, bolts, etc.).

The chair 400 may include a first chair seat side rail 309, a second chair seat side rail 311, a front chair seat cross member 320, a first intermediate chair seat cross member 313, and a second intermediate chair seat cross member 315. The first intermediate chair seat cross member 313 may be fixed to the first chair seat side rail 309 via, for example, a first chair seat bracket 310 (e.g., via welding, screws, bolts, etc.). Alternative, or additionally, the first intermediate chair seat cross member 313 may be directly fixed to the first chair seat side rail 309 (e.g., via welding, screws, bolts, etc.). The first intermediate chair seat cross member 313 may be fixed to the second chair seat side rail 311 via, for example, a second chair seat bracket (not shown in FIG. 3) (e.g., via welding, screws, bolts, etc.). Alternative, or additionally, the first intermediate chair seat cross member 313 may be directly fixed to the second chair seat side rail 311 (e.g., via welding, screws, bolts, etc.). The second intermediate chair seat cross member 315 may be fixed to the first chair seat side rail 309 via, for example, the first chair seat bracket 310 (e.g., via welding, screws, bolts, etc.). Alternative, or additionally, the second intermediate chair seat cross member 315 may be directly fixed to the first chair seat side rail 309 (e.g., via welding, screws, bolts, etc.). The second intermediate chair seat cross member 315 may be fixed to the second chair seat side rail 311 via, for example, the second chair seat bracket (not shown in FIG. 3) (e.g., via welding, screws, bolts, etc.). Alternative, or additionally, the second intermediate chair seat cross member 315 may be directly fixed to the second chair seat side rail 311 (e.g., via welding, screws, bolts, etc.). The front chair seat cross member 320 may be fixed to the first chair seat side rail 209 and the second chair seat side rail 311 via, for example, welding, screws, bolts, etc. The chair 400 may include a chair pivot bracket 321 extending between the first intermediate chair seat cross member 313 and the second intermediate chair seat cross member 315 such that, for example, a first locking hole 324 engages a first locking pin (not shown in FIG. 3) and a second locking hole 323 engages a second locking pin 314.

The chair back may pivot with respect to the chair seat. For example, the bottom of the chair back may be hingedly attached to the rear of the chair seat such that the chair back will fold flat against the chair seat. Thereby, a height of the foldable chair assembly 300 may be reduced for transporting and/or storing the foldable chair assembly 200. Similarly, the bottom of the chair back may be hingedly attached to the rear of the chair seat such that the chair back may recline relative to the chair seat. In any event, the bottom of the chair back may be hingedly attached to the rear of the chair seat via a mechanism that allows a user to reorient the chair back with respect to the chair seat in any number of orientations between an orientation where the chair back is folded against the chair seat and where the chair back is fully reclined, for example, parallel to the chair seat (e.g., the chair back and the chair seat may define a cot).

While not shown in FIG. 3, the foldable chair assembly 300 may include a "sling-type" occupant support extending, for example, between the first chair seat side rail 309 and the second chair seat side rail 311, and between the first chair back side rail 301 and the second chair back side rail 302. Additionally, or alternatively, the foldable chair assembly 300 may include a "sling-type" occupant support extending, for example, from the top chair back cross member 303 to the bottom chair back cross member 306 and on to the front chair seat cross member 320. The sling-type occupant support may include, for example, a polyvinyl chloride (PVC) mesh fabric, a vinyl-coated polyester material, an acrylic yarn, an olefin material, etc. The sling-type occupant support may include a composition of materials that is durable, easy-to-clean, colorfast, strong outdoor fabric, etc. The sling-type occupant support may include a composition of materials that inhibits mildew growth. Additionally, or alternatively, the chair back and/or the chair seat may include a rigid occupant support (e.g., wooden slats, plastic slats, aluminum slats, etc.). While not shown in FIG. 3, the chair 400 may include a fixed or removable cushion.

The base 500 may include a first side structure 331 fixed to a second side structure 337 via, for example, a front base cross member 329 and a back base cross member 330. The base 500 may include a base pivot bracket 327 extending between the front base cross member 329 and the back base cross member 330. The base 500 may include, for example, four pivotable legs 342. Each pivotable leg 342 may include, for example, a slotted pivot point 343, a leg pivot locating pin 344, a leg biasing member 352 (e.g., an elastic band, a rubber band, a spring, etc.), and a pivotable foot 354. The first side structure 331 may include a series of front leg pivot slots 335 and a series of rear leg pivot slots 336. Similarly, the second side structure 337 may include a series of front leg pivot slots 340 and a series of rear leg pivot slots 341. As described in detail elsewhere herein, a chair user may pivot a respective leg 342 by first linearly pulling the leg 342 toward a respective foot 354 such that the leg pivot locating pin 344 disengages a respective leg pivot slot 335, 336, 340, 341 and the slotted pivot point 343 slides on a respective pin (not shown in FIG. 3), thereby, stretching the respective leg biasing member 352. Once the leg pivot locating pin 344 disengages the respective leg pivot slot 335, 336, 340, 341, the user may pivot the leg 342 frontward or rearward as desired. Once the leg 342 is pivoted as desired, the user may release the leg 342 and the leg biasing member 352 may linearly retract the leg 342 toward the base 500 such that the leg pivot locating pin 344 engages the respective leg pivot slot 335, 336, 340, 341.

Figure 4:
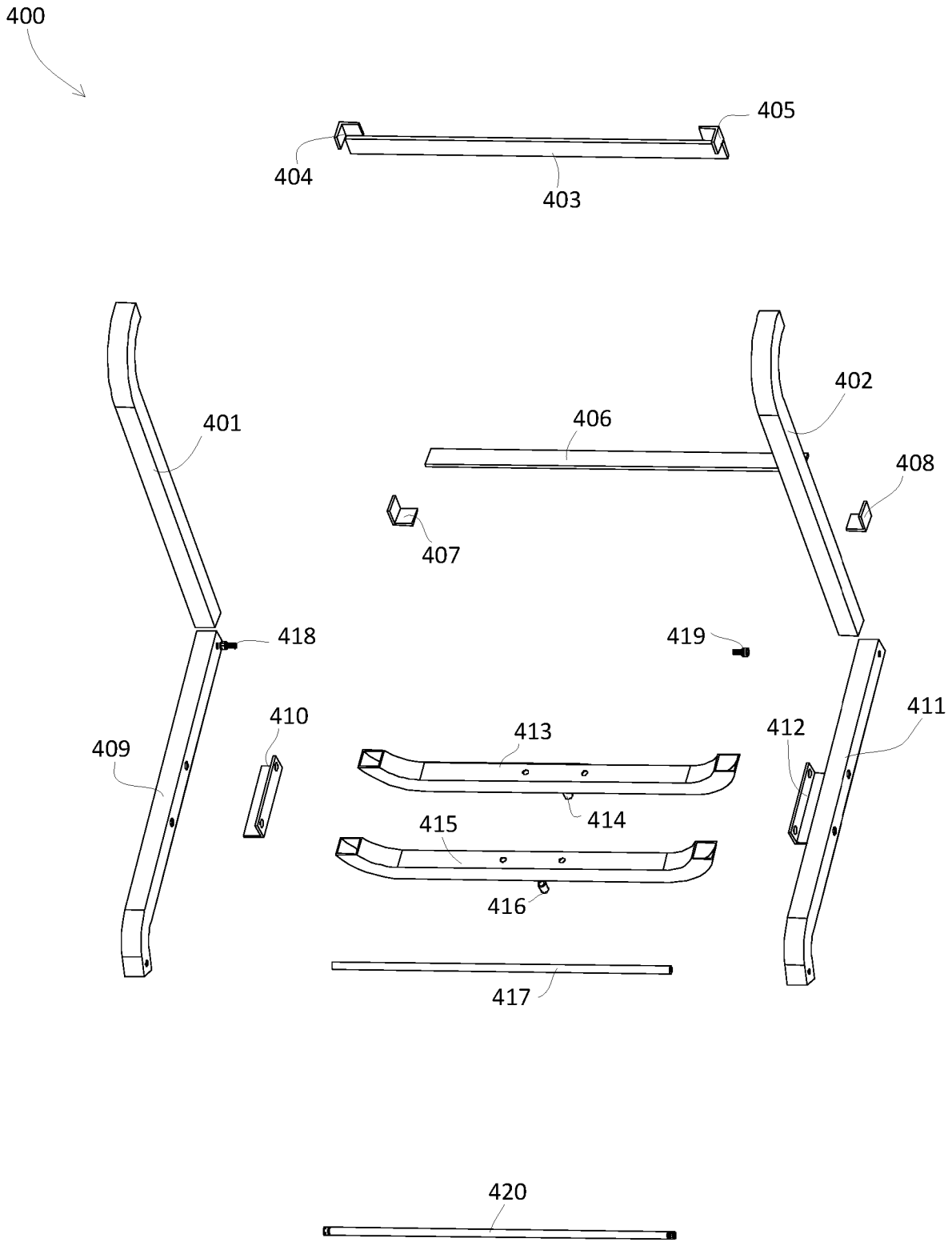
FIG. 4 depicts an exploded front top perspective view of the example chair for use with the example chair assemblies of FIGS. 1-3.

With reference to FIG. 4, a chair 400 may be similar to, for example, any chair 400 of the chair assemblies 100, 200, 300 of FIGS. 1-3, respectively. The chair 400 may include a first chair back side rail 401, a second chair back side rail 402, a top chair back cross member 403, and a bottom chair back cross member 406. The top chair back cross member 403 may be fixed to the first chair back side rail 401 via, for example, a first chair back bracket 404 (e.g., via welding, screws, bolts, etc.). Alternative, or additionally, the top chair back cross member 403 may be directly fixed to the first chair back side rail 401 (e.g., via welding, screws, bolts, etc.). The top chair back cross member 403 may be fixed to the second chair back side rail 402 via, for example, a second chair back bracket 405 (e.g., via welding, screws, bolts, etc.). Alternative, or additionally, the top chair back cross member 403 may be directly fixed to the second chair back side rail 402 (e.g., via welding, screws, bolts, etc.). The bottom chair back cross member 406 may be fixed to the first chair back side rail 401 via, for example, a third chair back bracket 407 (e.g., via welding, screws, bolts, etc.). Alternative, or additionally, the bottom chair back cross member 406 may be directly fixed to the first chair back side rail 401 (e.g., via welding, screws, bolts, etc.). The bottom chair back cross member 406 may be fixed to the second chair back side rail 402 via, for example, a fourth chair back bracket 408 (e.g., via welding, screws, bolts, etc.). Alternative, or additionally, the bottom chair back cross member 406 may be directly fixed to the second chair back side rail 402 (e.g., via welding, screws, bolts, etc.).

The chair 400 may include a first chair seat side rail 409, a second chair seat side rail 411, a rear chair seat cross member 417, a front chair seat cross member 420, a first intermediate chair seat cross member 413, and a second intermediate chair seat cross member 415. The rear chair seat cross member 417 may be fixed to the first chair seat side rail 409 and the second chair seat side rail 411 via, for example, welding, screws, bolts, etc. The first intermediate chair seat cross member 413 may be fixed to the first chair seat side rail 409 via, for example, a first chair seat bracket 410 (e.g., via welding, screws, bolts, etc.). Alternative, or additionally, the first intermediate chair seat cross member 413 may be directly fixed to the first chair seat side rail 409

(e.g., via welding, screws, bolts, etc.). The first intermediate chair seat cross member 413 may be fixed to the second chair seat side rail 411 via, for example, a second chair seat bracket 412 (e.g., via welding, screws, bolts, etc.). Alternative, or additionally, the first intermediate chair seat cross member 413 may be directly fixed to the second chair seat side rail 411 (e.g., via welding, screws, bolts, etc.). The second intermediate chair seat cross member 415 may be fixed to the first chair seat side rail 409 via, for example, the first chair seat bracket 410 (e.g., via welding, screws, bolts, etc.). Alternative, or additionally, the second intermediate chair seat cross member 415 may be directly fixed to the first chair seat side rail 409 (e.g., via welding, screws, bolts, etc.). The second intermediate chair seat cross member 415 may be fixed to the second chair seat side rail 411 via, for example, the second chair seat bracket 412 (e.g., via welding, screws, bolts, etc.). Alternative, or additionally, the second intermediate chair seat cross member 415 may be directly fixed to the second chair seat side rail 411 (e.g., via welding, screws, bolts, etc.). The front chair seat cross member 420 may be fixed to the first chair seat side rail 409 and the second chair seat side rail 411 via, for example, welding, screws, bolts, etc. The chair 400 may include a chair pivot bracket (not shown in FIG. 4) extending between the first intermediate chair seat cross member 413 and the second intermediate chair seat cross member 415 such that, for example, a first locking hole (not shown in FIG. 4) engages a first locking pin 416 and a second locking hole (not shown in FIG. 4) engages a second locking pin 414.

The chair back may pivot with respect to the chair seat. For example, the bottom of the chair back may be hingedly attached to the rear of the chair seat such that the chair back will fold flat against the chair seat. Thereby, a height of an associated foldable chair assembly (e.g., foldable chair assembly 100, 200, 300) may be reduced for transporting and/or storing the flodable chair assembly 100, 200, 300. Similarly, the bottom of the chair back may be hingedly attached to the rear of the chair seat such that the chair back may recline relative to the chair seat. In any event, the bottom of the chair back may be hingedly attached to the rear of the chair seat via a mechanism that allows a user to reorient the chair back with respect to the chair seat in any number of orientations between an orientation where the chair back is folded against the chair seat and where the chair back is fully reclined, for example, parallel to the chair seat (e.g., the chair back and the chair seat may define a cot).

While not shown in FIG. 4, the foldable chair assembly 100, 200, 300 may include a "sling-type" occupant support extending, for example, between the first chair seat side rail 409 and the second chair seat side rail 411, and between the first chair back side rail 401 and the second chair back side rail 402. Additionally, or alternatively, the foldable chair assembly 100, 200, 300 may include a "sling-type" occupant support extending, for example, from the top chair back cross member 403 and the bottom chair back cross member 406, and from the rear chair seat cross member 417 to the front chair seat cross member 420. The sling-type occupant support may include, for example, a polyvinyl chloride (PVC) mesh fabric, a vinyl-coated polyester material, an acrylic yarn, an olefin material, etc. The sling-type occupant support may include a composition of materials that is durable, easy-to-clean, colorfast, strong outdoor fabric, etc. The sling-type occupant support may include a composition of materials that inhibits mildew growth. Additionally, or alternatively, the chair back and/or the chair seat may include a rigid occupant support (e.g., wooden slats, plastic slats, aluminum slats, etc.). While not shown in FIG. 4, the chair 400 may include a fixed or removable cushion.

Figure 5:
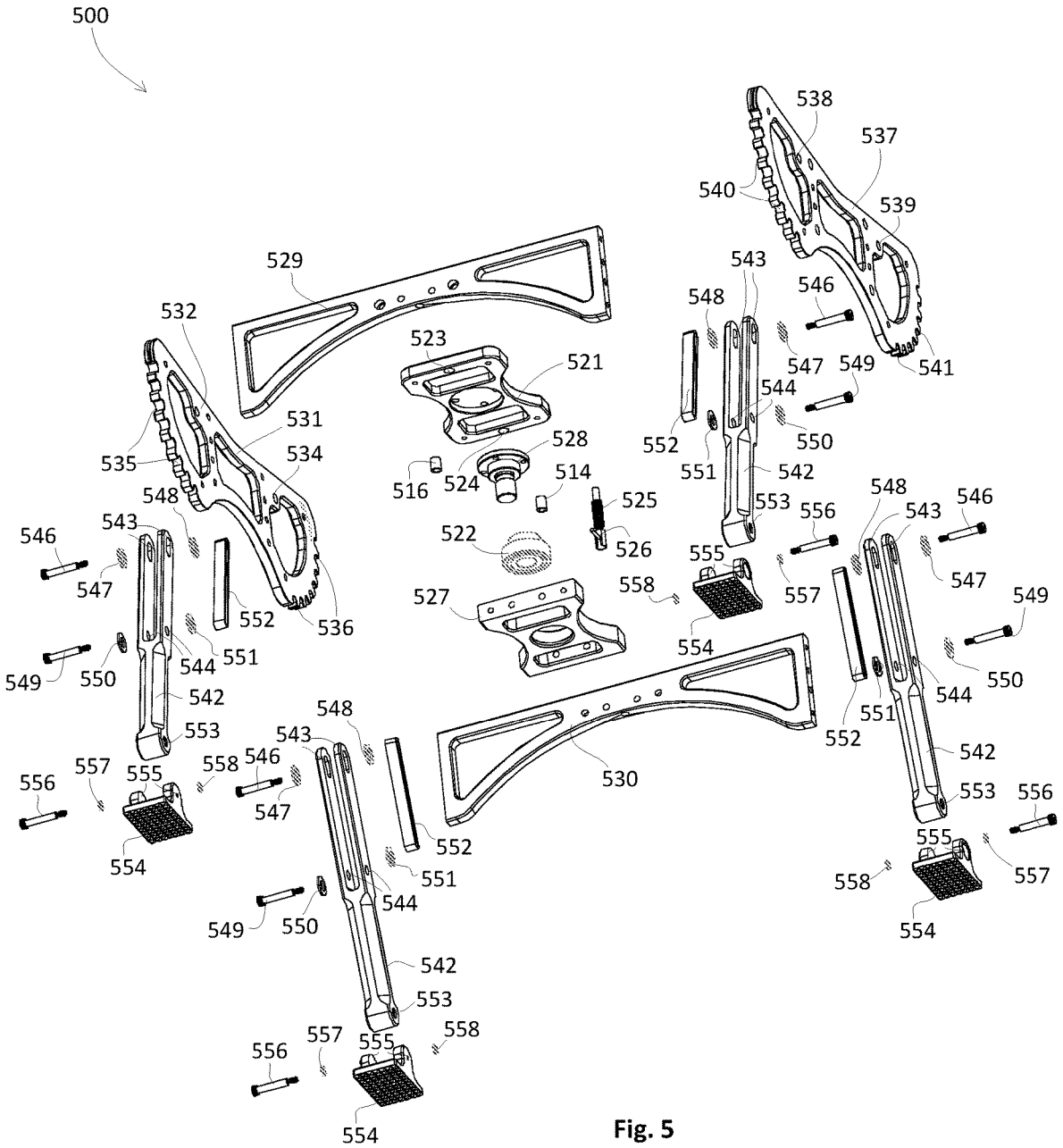
FIG. 5 depicts an exploded front bottom perspective view of the example base for use with the example chair assembly of FIGS. 1-3.

Turning to FIG. 5, a base 500 may be similar to, for example, any base 500 of the chair assemblies 100, 200, 300 of FIGS. 1-3, respectively. The base 500 may include a first side structure 531 fixed to a second side structure 537 via, for example, a front base cross member 529 and a back base cross member 530. The base 500 may include a base pivot bracket 527 extending between the front base cross member 529 and the back base cross member 530. The base 500 may include, for example, four pivotable legs 542. Each pivotable leg 542 may include, for example, a slotted pivot point 543, a slotted pivot point pin 546 with washer 547 and locking clip 548, a leg pivot locating pin hole 544, a leg pivot locating pin 549 with washer 550 and locking clip 551, a leg biasing member 552 (e.g., an elastic band, a rubber band, a spring, etc.), foot pivot hole 553, a pivotable foot 554 with a foot pivot hole 555, and a foot pivot pin 556 having a washer 557 and locking clip 558. Each leg 542 may be, for example, secured to a respective first side structure 531 or second side structure 537 with a respective slotted pivot point pin 546 extending through a washer 547, through a first side of the slotted pivot point 543, through a respective pivot hole 532, 534, 538,539, through a second side of the slotted pivot point 543, and with the slotted pivot point pin 546 secured via a locking clip 548. Each leg pivot locating pin 549 may extend through a respective washer 550, a first side of the leg pivot locating pin hole 544, through a second side of the leg pivot locating pin hole 544, and secured via a locking clip 551. An end of the slotted pivot point pin 546 may extend beyond the locking clip 548 and an end of the leg pivot locating pin 549 may extend beyond the locking clip 551 with a respective leg biasing member extending between the end of the slotted pivot point pin 546 and the end of the leg pivot locating pin 549.

Each foot 554 may be pivotally secured to a respective leg 542 with a leg pin 556 extending through a washer 557, through a first side of a foot pivot hole 555, through a foot pivot hole 553, through a second side of the foot pivot hole 555, and secured with a locking clip 558. Alternatively, each foot 554 may be fixed to a respective leg 542 and a bottom of the foot 554 may be curved such that the a portion of a bottom of the foot 554 may contact a surface (e.g., the ground, a floor, etc.) irrespective of an orientation of the leg 542.

The base pivot bracket 527 may include a pivot bushing 522 configured to removably receive a swivel pin 528. The swivel pin 528 may be secured to a chair pivot bracket 521 having a first locking sleeve 514 within a first locking hole 523 and a second locking sleeve 516 within a second locking hole 524. The base 500 may include a swivel/pivot locking mechanism 526 with a threaded portion 525. An end of the swivel/pivot locking mechanism 526 may be received within, or removed from, either the first locking sleeve 514 or the second locking sleeve 516 when a user, for example, turns the swivel/pivot locking mechanism 526.

The first side structure 531 may include a series of front leg pivot slots 535 and a series of rear leg pivot slots 536. Similarly, the second side structure 537 may include a series of front leg pivot slots 540 and a series of rear leg pivot slots 541. As described in detail elsewhere herein, a chair user may pivot a respective leg 542 by first linearly pulling the leg 542 toward a respective foot 554 such that the leg pivot locating pin 544 disengages a respective leg pivot slot 535, 536, 540, 541 and the slotted pivot point 543 slides on a respective pin 546, thereby, stretching the respective leg biasing member 552. Once the leg pivot locating pin 549 disengages the respective leg pivot slot 535, 536, 540, 541, the user may pivot the leg 542 frontward or rearward as desired. Once the leg 542 is pivoted as desired, the user may release the leg 542 and the leg biasing member 552 may linearly retract the leg 542 toward the base 500 such that the leg pivot locating pin 549 engages the respective leg pivot slot 535, 536, 540, 541.

Individual portions of a foldable chair assembly 100, 200, 300, a chair 400, and a base may be fabricated from, for example, 6061 aluminum alloy, carbon reinforced fiber, a composite material, etc. Alternatively, or additionally, any one of the pins 546, 556, 528 and the bushing 522 may be fabricated from, for example, stainless steel.

A chair 400 may be removably supported by a base 500. The legs 542 may be removable from the base such that a height of a given base 500 may be reduced for transportation and/or storage. A carrying case may be provided for transporting and storage of a foldable chair assembly 100, 200, 300. The carrying case may include "back-pack" straps such that a user may carry a foldable chair assembly 100, 200, 300 as a back-pack. Alternatively, or additionally, a carrying case may include a shoulder strap and/or a hand strap for carrying a foldable chair assembly 100, 200, 300. Alternatively, back-pack straps, a shoulder strap and/or a hand strap may be secured directly to, for example, a chair 400 and/or a base 500.

A base 500 may include a first side structure 531 and a second side structure 537 that are hingably connected to a front base cross member 529 and a back base cross member 530 such that the legs 542 may fold, for example, inward such that a height of the base may be reduced for transportation and/or storage. Combined with a chair back that is pivotable with respect to a chair seat, an overall height of a foldable chair assembly may be equivalent to a thickness of the chair back, a thickness of a chair seat, and a thickness of a leg/foot. A foldable chair assembly 100, 200, 300 may include a strap to secure the foldable chair assembly in a folded orientation.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed is:

1. A foldable chair assembly, comprising:

a chair; and a base having four legs pivotally attached to the base via a respective pivot pin, wherein the base includes a series of leg pivot slots associated with each respective leg, wherein each leg is independently pivotable with respect to any other leg, wherein each pivot pin is received within a slotted pivot point of the respective leg, wherein each leg includes a respective leg pivot locating pin, wherein each leg includes a respective leg biasing member, wherein each leg biasing member is configured to bias the respective leg in a linear direction that is parallel to a line extending from a first end of each leg to a second end of the respective leg, and wherein the chair is swivebly supported on the base.

2. The foldable chair assembly of claim 1, wherein the chair includes a chair back that is pivotally attached to a chair seat.

3. The foldable chair assembly of claim 1, wherein the chair is pivotable with respect to the base.

4. The foldable chair assembly of claim 1, wherein the chair includes a sling-type occupant support.

5. The foldable chair assembly of claim 1, wherein each leg biasing member is an elastic band extending from the respective pivot pin to the respective leg pivot locating pin.

6. The foldable chair assembly of claim 1, wherein the chair is removably supported on said base via a swivel pin.

7. The foldable chair assembly of claim 1, wherein each leg includes a respective leg pivot locating pin, wherein each leg includes a respective leg biasing member, wherein each leg biasing member is configured to bias each leg pivot locating pin into a respective leg pivot slot.

8. A foldable chair assembly, comprising:

a chair; and a base having four legs pivotally attached via a respective pivot pin, wherein each leg is independently pivotable with respect to any other leg, wherein the base includes a series of leg pivot slots associated with each respective leg, and wherein each leg includes a respective leg biasing member configured to bias a leg pivot locating pin of each leg into a respective leg pivot slot.

9. The foldable chair assembly of claim 8, wherein the chair is configured to be swiveled with respect to the base.

10. The foldable chair assembly of claim 8, further comprising:

a chair swivel having a swivel pin receivable within a hushing.

11. The foldable chair assembly of claim 8, wherein each leg biasing member is an elastic band extending from the respective pivot pin to the respective leg pivot locating pin.

12. The foldable chair assembly of claim 8, wherein each leg biasing member is a coil spring extending from the respective pivot pin to the respective leg pivot locating pin.

13. A foldable chair assembly, comprising:

a base having at least three legs pivotably attached to the base via a respective pivot pin, wherein a first leg of the at least three legs is pivotably adjustable with respect to the base, wherein a second leg of the at least three legs is pivotably adjustable with respect to the base, wherein a third leg of the at least three legs is pivotably adjustable with respect to the base, wherein the first leg, the second leg, and the third leg of the at least three legs are independently pivotably adjustable with respect to each other, wherein the at least three legs are pivotably attached to the base via a respective pivot pin, wherein each pivot pin is received within a slotted pivot point of the respective leg, wherein each leg includes a respective leg pivot locating pin, and wherein each leg includes a respective leg biasing member, wherein each leg biasing member is configured to bias the respective leg in a linear direction that is parallel to a line extending from a first end of each leg to a second end the leg.

14. The foldable chair assembly of claim 13, wherein the chair includes a chair back that is pivotally attached to a chair seat.

15. The foldable chair assembly of claim 13, wherein the chair is pivotable with respect to the base.

16. The foldable chair assembly of claim 13, wherein the chair is configured to be swiveled with respect to the base.

17. The foldable chair assembly of claim 13, wherein the chair is removably supported on said base via a swivel mechanism.

* * * * *